United States Patent [19]

Garrett

[11] 4,320,808

[45] Mar. 23, 1982

[54] ROTARY DRILL BIT

[76] Inventor: Wylie P. Garrett, P.O. Box 1672, Hammond, La. 70404

[21] Appl. No.: 162,463

[22] Filed: Jun. 24, 1980

[51] Int. Cl.[3] ..... E21B 10/16; E21B 10/52

[52] U.S. Cl. ..... 175/340; 175/374; 175/377; 175/410

[58] Field of Search ..... 175/340, 353, 374, 375, 175/377, 378, 410

[56] References Cited

U.S. PATENT DOCUMENTS

| | | | |
|---|---|---|---|
| 1,607,937 | 11/1926 | Aldrin | 175/377 |
| 1,663,332 | 3/1928 | Bull | 175/377 |
| 1,816,549 | 7/1931 | Starkey | 175/377 |
| 1,860,587 | 5/1932 | Metzger | 175/377 |
| 2,121,202 | 6/1938 | Killgoro | 175/374 |
| 2,228,286 | 1/1941 | Ross | 175/377 |
| 2,244,617 | 6/1941 | Hannum | 175/377 |

*Primary Examiner*—James A. Leppink
*Attorney, Agent, or Firm*—Bradford E. Kile

[57] ABSTRACT

A rotary drill bit and drill bit cone for drilling bore holes through earth formations. The rotary drill bit includes a generally hollow body portion having a plurality of longitudinally extending shanks which terminate with inwardly directed spindles. A cutting cone is mounted upon each shank spindle and is provided with a plurality of elevated, primary, land areas which extend in a spiral pattern from the apex of the cone to the base. In a preferred embodiment, a plurality of elevated, secondary, land areas spiral from points intermediate the apex and base of the cone to the base of the cone in an alternate arrangement with the primary land areas. Cutting teeth are mounted upon each of the primary and secondary spiral land areas for digging into the earth formations during a drilling operation and in a preferred embodiment comprised partial disc shaped members which are embedded into the land portions of the spiral drill cone. A plurality of jet nozzles are mounted through the drill bit body and are generally directed between the shanks to project lubricating and cleansing drill fluid onto the rotating cutting cones and/or earth formation during a drilling operation. The maximum gauge of the drill bit is provided by an arcuate and annular enlargement zone fashioned generally at the base of each cutting cone. This zone enlarges the bore hole and facilitates vertical drill bit penetration.

17 Claims, 11 Drawing Figures

FIG.1
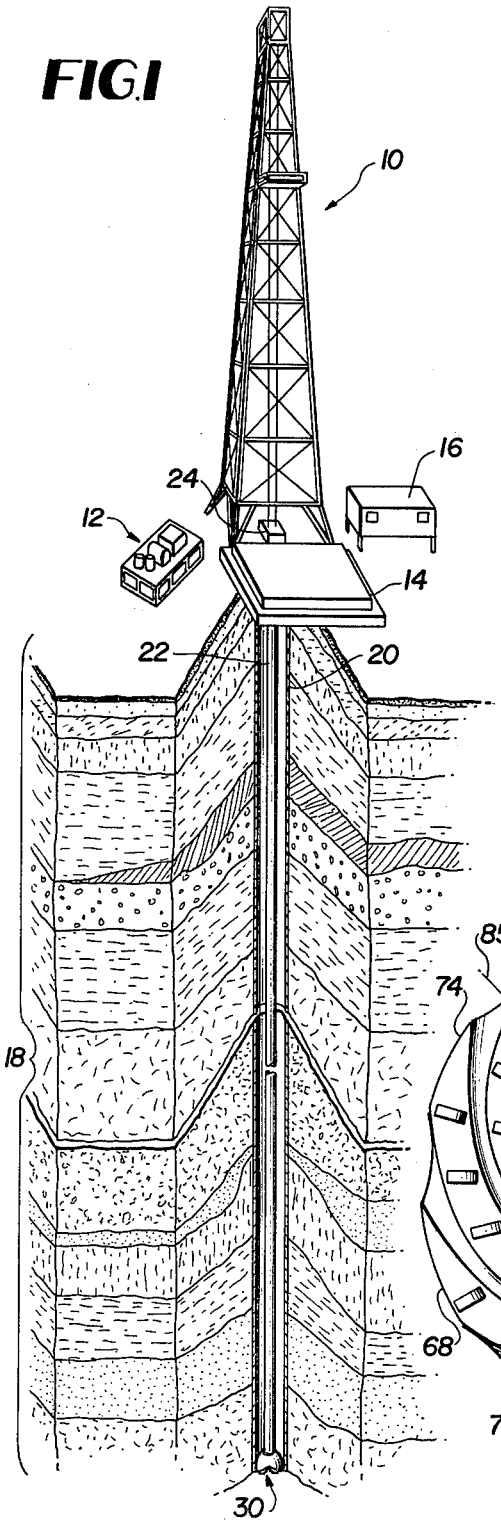
FIG.4
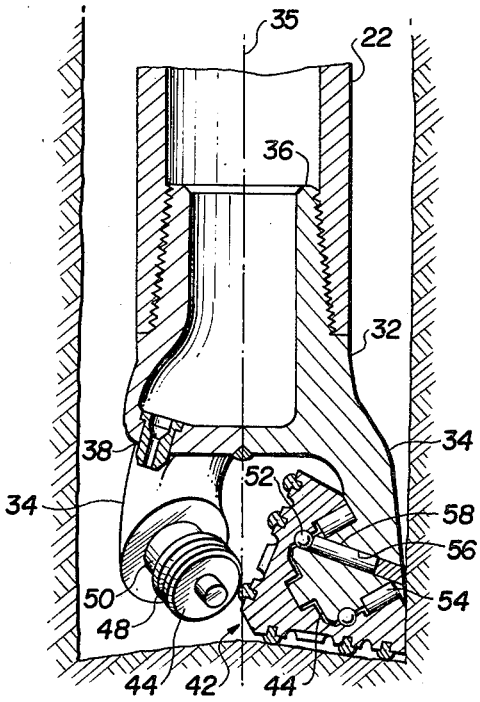
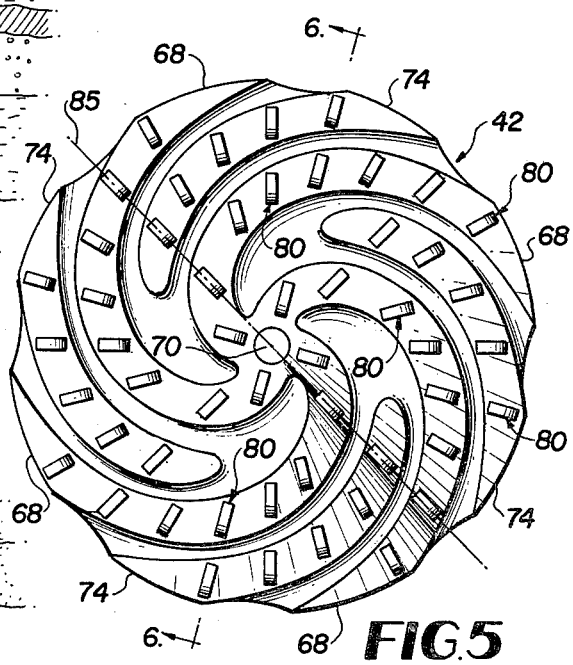
FIG.5

FIG.8
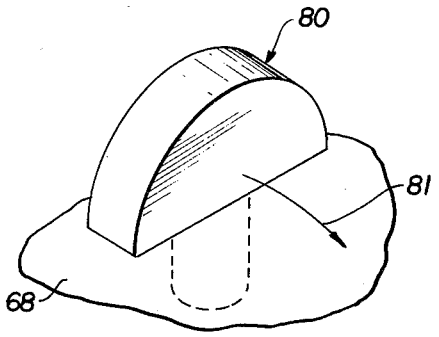
FIG.9
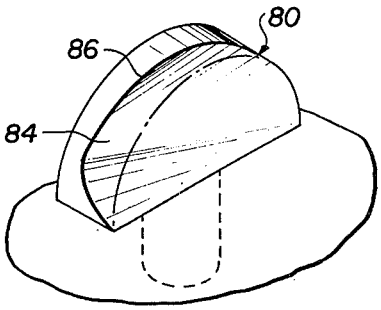
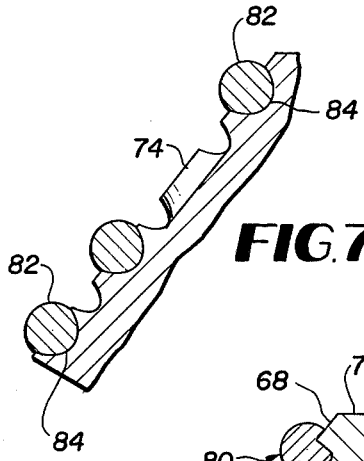
FIG.7
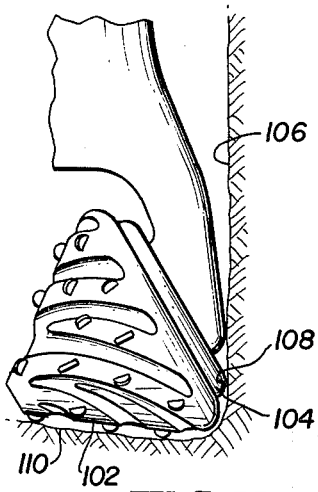
FIG.11
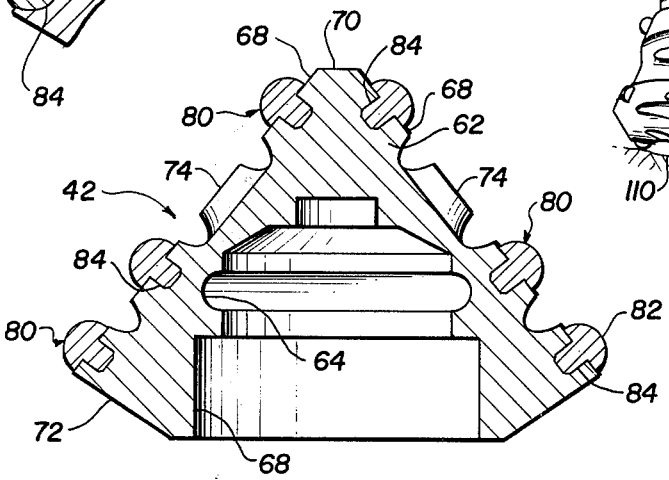
FIG.6

ROTARY DRILL BIT

BACKGROUND OF THE INVENTION

This invention relates to a rotary drill bit and drill bit cone for straight hole drilling through earth formations.

The concept of penetrating the surface of the earth to tap subterranean sources of water and minerals has been known for centuries. Within the last century, however, increased attention has been directed to earth boring to tap zones of fossel fuel such as gas and oil lying thousands of feet beneath the surface of the earth.

Drill bits which must function at such depths should be somewhat versatile and capable of penetrating a variety of earth strata without displaying excess wear and/or poor penetration rates.

One previously known drill bit design which has achieved a wide degree of utilization is generically known as a rotary drill bit. In this regard, a drill bit body is fitted with a plurality of rotatable cutting cones. The drill bit body is mounted at the end of a rotary drill string. As the drill body is rotated in a drill hole the cutting cones rotate relative to the bit and drill through earth formations. A drilling fluid or mud slurry is pumped down the drill string and is directed around and between the cutting cones to keep the cutting surfaces lubricated and to flush away particulate matter dislodged during the drilling operation.

A wide variety of rotary drill bit and cutting cone designs have been at least theorized in the past. In one design, a plurality of chisel shaped cutting teeth are mounted in layers about a cutting cone. Each layer is offset such that the tips of the chisel teeth form a general spiral pattern. In another design, spiral cutting edges are fashioned from the apex to the base of a rotatable cutting cone. Principally, however, rotary drill bits are provided with annular rows of generally rounded or "knob" like hardened inserts which serve to grind away an earth formation as the drill bit body is rotated.

While rotary drill bits of the general type previously described have been widely utilized, each of the previously known designs exhibit at least some limitations. More specifically, some rotary drill bits and cutting cones provide superior initial penetration rates but wear quickly. In order to replace a worn bit, the entire drill string must be pulled which necessarily dictates undesirable drilling down time. Other designs which exhibit increased bit wear properties sometimes do not provide an acceptable penetration rate and/or exhibit poor drilling performance in various earth strata. Still further, many previously known bit designs are easily clogged and difficult to keep clean, even with high drilling fluid flow rates, during a drilling operation.

The difficulties suggested in the preceding are not intended to be exhaustive, but rather are among many which may tend to reduce the effectiveness and operator satisfaction with prior rotary drill bits and drill bit cones. Other noteworthy problems may also exist; however, those presented above should be sufficient to demonstrate that rotary drill bits and drill bit cones appearing in the past will admit to worthwhile improvement.

OBJECTS OF THE INVENTION

It is therefore a general object of the invention to provide a novel rotary drill bit and drill bit cone which will obviate or minimize difficulties of the type previously described.

It is a specific object of the invention to provide a novel rotary drill bit and drill bit cone wherein lubricating fluid may be advantageously channeled around and over the rotating cutting cones.

It is another object of the invention to provide a novel rotary drill bit and drill bit cone for straight hole drilling wherein drilling performance is enhanced.

It is still another object of the invention to provide a novel rotary drill bit and drill bit cone which will exhibit enhanced wear characteristics while providing advantageous cutting action during a drilling operation.

It is a further object of the invention to provide a novel rotary drill bit and drill bit cone wherein cutting teeth, upon the drill bit cone, are self sharpening during a drilling operation.

It is yet a further object of the invention to provide a novel rotary drill bit and drill bit cone wherein progressive digging action is provided by cutting teeth as the cone rotates during a drilling operation.

It is yet still a further object of the invention to provide a novel rotary drill bit and drill bit cone which will resist tendencies for clogging action and deviation in a wide variety of earth formations.

BRIEF SUMMARY OF THE INVENTION

A rotary drill bit and drill bit cone in accordance with a preferred embodiment of the invention which is intended to accomplish at least some of the foregoing objects includes a generally hollow body portion having a plurality of longitudinally extending shanks which terminate with inwardly directed spindles. A cutting cone is mounted upon each shank spindle and is provided with a plurality of elevated, primary, land areas which extend in a spiral pattern from the apex of the cone to the base. In a preferred embodiment, a plurality of elevated, secondary, land areas spiral from points intermediate the apex and base of the cone to the base of the cone in an alternate arrangement with the primary land areas. Cutting teeth are mounted upon each of the primary and secondary spiral land areas for digging into the earth formations during a drilling operation and in a preferred embodiment comprised partial disc shaped members which are embedded into the land portions of the spiral drill cone. A plurality of jet nozzles are mounted through the drill bit body and are generally directed between the shanks to project lubricating and cleansing drill fluid onto the rotating cutting cones and/or earth formation during a drilling operation. The maximum gauge of the drill bit is provided by an arcuate and annular enlargement zone fashioned generally at the base of each cutting cone. The arcuate wear zone serves to follow-up and enlarge a drill hole formed by cutting teeth and thus facilitates vertical penetration.

THE DRAWINGS

Other objects and advantages of the invention will become apparent from the following detailed description of preferred embodiments thereof taken in conjunction with the accompanying drawings, wherein:

FIG. 1 is an axonometric view of a straight hole drilling rig which may advantageously utilize a drill bit of the subject invention;

FIG. 2, note sheet 2, is a fragmentary view of a drill bit in accordance with a preferred embodiment of the invention operably drilling through an earth formation wherein formation fines and particulate matter are lifted to the surface via a circulating drilling fluid;

FIG. 3 is a bottom view of a three cone rotary drill bit in accordance with the invention;

FIG. 4, note sheet 1, is a sectional view of the subject drill bit which discloses a cutter cone mounting arrangement and a drilling fluid flow path through the drill bit body;

FIG. 5 is an end view of a spiral drill bit cone in accordance with the invention;

FIG. 6, note sheet 3, is a cross-sectional view of the spiral drill bit cone as taken along section line 6—6 in FIG. 5 and particularly discloses the mounting of disc shaped cutting teeth on spiral elevated lands of the cutting cone;

FIG. 7 is a fragmentary cross-sectional view of an alternative mounting arrangement of the disc shaped cutting teeth on the spiral land areas of the cutting cone;

FIG. 8 is a detailed view of a disc shaped drill bit tooth in accordance with the invention;

FIG. 9 is a view of the disc shaped drill bit tooth depicted in FIG. 8 upon partial wear.

Figure 2:
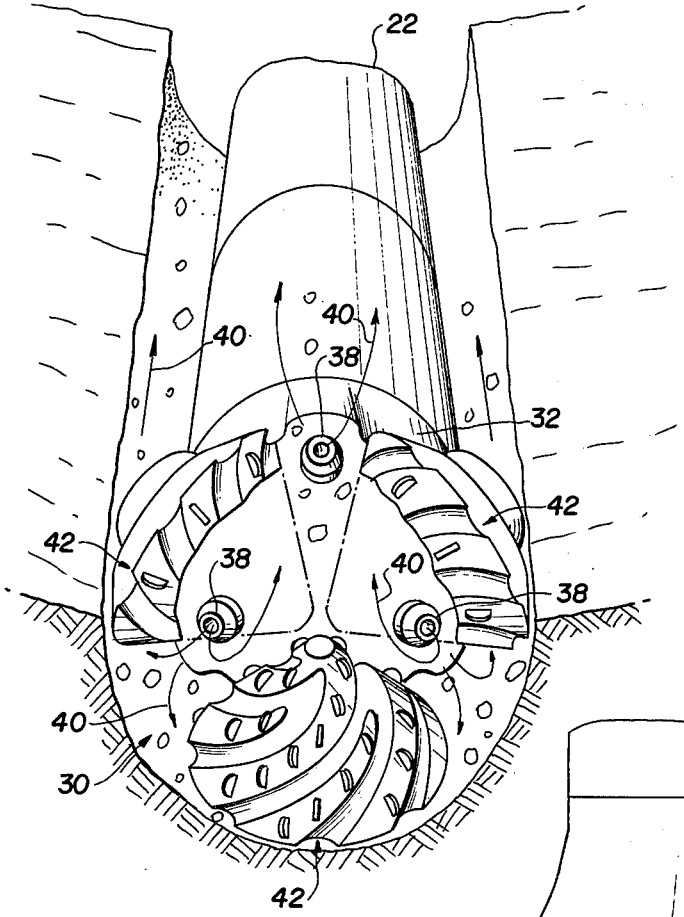

FIG. 11, note sheet 3, is a partial side view of a rotary drill bit wherein an arcuate and annular zone is fashioned at the base of the cutting cones to provide an enlargement of the drill hole and facilitate vertical drill bit penetration.

DETAILED DESCRIPTION

Context of the Invention

Before providing a detailed description of the subject rotary drill bit and drill bit cone it may be worthwhile to briefly outline the context of the instant invention. In this connection, FIG. 1 is an axonometric view of a straight hole drilling rig which may advantageously utilize a rotary drill bit in accordance with the instant invention.

More specifically, a conventional open lattice derrick 10 is positioned above an earth formation to be drilled. Drilling fluid processing equipment such as air compressors and fluid pumps 12 are installed adjacent the derrick base. In addition, draw works and drive machinery 14 are mounted adjacent the derrick for pipe handling and driving the drill string. A control housing 16 is provided for personnel and monitoring of the drilling operations.

As depicted in FIG. 1, drilling has proceeded through various earth strata 18 such as light soils, clays, sand, shale, limestone, sandstone, granite and the like and a casing 20 has been installed within the drill bore. Drilling action is provided by rotating a drill pipe or drill stem 22 by a turntable 24 mounted at the base of the derrick 10. The drill pipe 22 serves to rotate a rotary drill bit 30 carrying drill bit cones which engage and cut through the various earth formation as the drill bit head 30 penetrates the earth.

During the drilling operation, a drilling fluid such as water carrying suspended fines, to increase the drilling fluid density, is pumped down the center of the drill pipe 22 and out the drilling head 30 to flush particulate matter and fines, which have been cut away from the earth formation, away from the cutting cones and up around the annulus between the casing 20 and drill pipe 22 to the surface where the drilling fluid is filtered, reconditioned and recycled.

Rotary Drill Bit

Figure 3:
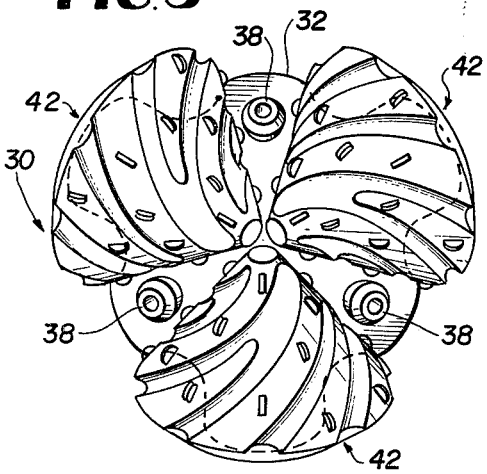

Referring now to FIGS. 2 through 4, there will be seen various views of a rotary drill bit in accordance with a preferred embodiment of the invention. The rotary drill bit 30 is composed of a generally hollow body portion 32 having a plurality of downwardly extending shanks 34 which project generally longitudinal along a central longitudinal axis 35 of the rotary drill bit. The other end of the drill bit body 32 is provided with a threaded shank or pin 36 which is releasably mated with a distal end of the drill pipe or drill stem 22.

A lowermost portion of the drill bit body 32 is provided with a plurality of nozzles 38. These nozzles 38 project generally downwardly and outwardly from the hollow drill body and served to direct and increase the velocity of drilling fluid pumped down the drill string.

The angle of the nozzles 38 may be varied depending upon the particular working conditions, but in general the nozzles directed between adjacent shank portions and either onto or around cutting cones which will be discussed in detail hereinafter. In this regard, the drilling fluid which jets from the nozzles 38 serves to lubricate and clean the cutting heads, pick up and flush away particulate matter and drilling fines and to a lesser degree erode away at the earth formation adjacent the cutting head. The directional arrows 40 in FIG. 2 serve to schematically depict the action of pressurized drilling field as it is jetted around cutting cones and into an earth formation during a drilling operation.

Cutting cones 42 are mounted upon a lowermost portion of the downwardly depending shanks 34. The rotary cones 42 are journaled upon inwardly directed stub shafts or spindles 44 which are generally directed toward the central longitudinal axis 35 extending through the rotary drill bit. Each of the spindles is provided with an outer 48 and inner 50 race which is operable to receive ball 52 or roller 54 bearings respectively to rotatably journal the drilling cone upon the end of the shank. Assembly is provided by the provision of a bore 56 which is fashioned angularly through the spindle 44 and is operable to receive the roller balls 52. Upon filling of the race 48, a plug 58 is positioned within the bore 56 and welded in place. Accordingly, the cutting cone 42 is axially mounted but free to rotate about the spindle axis as the rotary drill bit body 32 is rotated about axis 35.

Rotary Bit Cone

Referring now specifically to FIGS. 5 and 6, there will be seen detailed views of a rotary cutting cone 42 in accordance with a preferred embodiment of the invention. More specifically, the cutting cone 42 is provided with a generally hollow conical body 62 having an interior surface which is fashioned with an inner 64 and outer 66 race dimensioned to cooperate with the outer 48 and inner 50 races respectively of a corresponding spindle 44 and provide a rotatable mounting of the cone 42 upon the drill bit body as previously described.

The exterior surface of the cutting cone body 62 is fashioned with a plurality of primary raised or elevated land zones or areas 68 which extend from an apex 70 of the cone body and terminate at a champfered base portion 72 of the cone. These primary land areas 68 form a gentle spiral strip from the apex to the base of the cone body. In a preferred embodiment four strips 68 are provided which generally spiral approximately 90 degrees from the apex to the base of the cutting cone.

In addition to the primary, spiral, land areas 68, in a preferred embodiment, a plurality of secondary land areas 74 are also provided. These secondary land zones are raised to an elevation comparable with the primary land zones but originate from an intermediate position between the apex and the base of the cone and terminate at the base of the cone. The secondary land zones alternate with the primary land zones as depicted particularly in FIG. 5 to form a dual spiral pattern of lands and recessed channels on the exterior surface of the cutting cone.

A plurality of partial disc shaped cutting teeth 80 are mounted upon the primary and secondary spiral land areas and serve to directly engage and cut away at virgin earth formations during a drilling operation.

Each of the cutting discs 80 is fashioned with an upper portion 82 comprising a semi-disc shaped structure and a lower portion 84 which is embedded into one of the land surfaces for mounting the disc onto the cutting cone. As noted in FIG. 6, the cross sectional configuration of the mounting portion 84 may be a generally cylindrical shape and press fit into the land areas. In an alternative embodiment depicted in FIG. 7, a rounded lower configuration may be advantageously utilized to prevent torque induced movement of the cutting discs during a drilling operation. In addition to the generally curved lower portion 84 depicted in FIG. 7, other polygonal, non-circular, configurations are contemplated which may be triangular, square, rectangular, etc. in cross-section.

In a preferred embodiment, depicted in FIG. 3, the disc shaped cutting teeth are oriented to lie upon imaginery lines of generation 85 of the cone surface and thus the cutting teeth will be drug generally broadside across the earth formation during a drilling operation.

The cutting teeth 80 are subject to substantial abrading action and accordingly are preferably composed of a tungsten steel or a toughened alloy composition which is resistant to wear.

Referring now to FIGS. 8 and 9, there will be seen views of a cutting disc 80 which depict wear characteristics of the subject invention. More specifically, FIG. 8 discloses a new disc which is carried in the direction of arrow 81 during a conventional drilling operation. In FIG. 9, the same disc 80 is shown wherein a forward zone 84 has been eroded away leaving a relatively sharp edge portion 86 to provide further cutting action.

Figure 10:
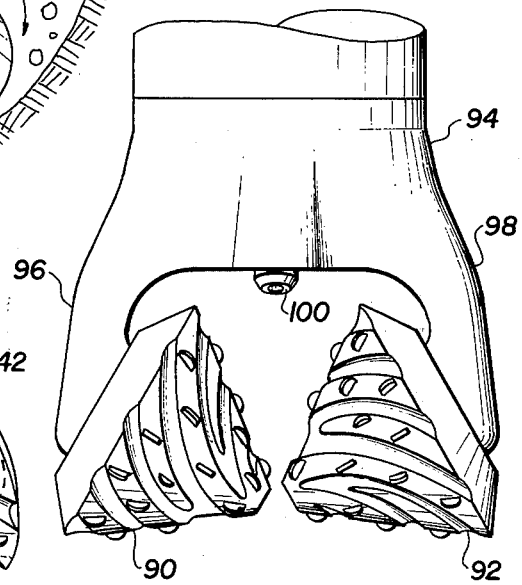
FIG. 10, note sheet 2, is a side view of a two cone rotary drill bit in accordance with an alternate preferred embodiment of the invention.

The number of cutting cones mounted upon each rotary drill bit body may vary with the anticipated conditions under which drilling is performed. A preferred arrangement is specifically depicted in FIG. 3 wherein three cutting cones are mutually spaced 120 degrees with respect to one another. An alternate preferred embodiment of the invention is depicted in FIG. 10 wherein a pair of spiral cutting cones 90 and 92 are mutually spaced apart 180 degrees and are mounted upon a drill bit body 94 having a first 96 and second 98 downwardly extending shank respectively. In this embodiment, a pair of fluid jet nozzles 100 are directed downwardly and slightly outwardly with respect to a central longitudinal axis of the tool body in order to jet into the earth formation and around the cutting heads 90 and 92.

FIG. 11 depicts a fragmentary view of an alternate preferred embodiment of the invention wherein each cutting cone 102, regardless of whether a two cone or three cone arrangement is utilized, is fashioned with an annular enlargement zone 104 which establishes the maximum gauge of the drill bit through an earth formation 106 as at 108.

The annular zone 104 is generally arcuate in cross-section and is preferably composed of a hardened wear resistant alloy or the like.

The maximum bore hole gauge is thus found upstream from the initial penetration of the drill bit teeth at the bottom 110 of the bore hole and is formed by a widening or reaming operation. This follow up concept provides lateral stability of the drill bit as the drill bit teeth penetrate an earth formation thus facilitating a vertical drilling operation.

SUMMARY OF MAJOR ADVANTAGES OF THE INVENTION

In describing a rotary drill bit and drill bit cone in accordance with preferred embodiments of the invention, those skilled in the art will recognize several advantages which singularly distinguish the invention from previously known rotary drill bits and drill bit cones.

A particular advantage of the invention is the provision of spiral land zones which extend along the outer surface of the cutting head. In a preferred embodiment, primary or major spirals and alternate, secondary, spirals extend about the cutting cone and facilitate cutting action while providing space for high pressure drilling fluid to freely circulate around the rotating cutting cone to keep the head and cutting surfaces clear for maximum penetration of the drill bit during a drilling operation.

The subject invention further provides a plurality of partial disc shaped cutting teeth which extend upon the elevated land portions preferably along development lines of the outer surface of the cutting cone. The semi-disc shaped cutting teeth are thus oriented with respect to the earth formation such that maximum cutting action is achieved as the teeth are drawn across the bottom of a drill hole with a "broadside" orientation.

The character of the disc shaped cutting teeth and the mounting orientation provides a wear pattern that is continually self sharpening and thus presents a relatively sharp surface throughout the wear life of the cone and rotary drill bit tool.

The arcuate and annular enlargement zone at the base of the cutting cone determines the maximum gauge of the bore hole by a upstream reaming action and facilitates vertical drilling through an earth formation.

In describing the invention, reference has been made to preferred embodiments. Those skilled in the art, howeve, and familiar with the disclosure of the subject invention may recognize additions, deletions, modifications, substitutions and/or other changes which will fall within the purview of the subject invention and claims.

What is claimed is:

1. A rotary drill bit for drilling bore holes through earth formations, said rotary drill bit comprising:

a generally hollow body means having a plurality of shank portions extending generally longitudinally from one end thereof and a pin portion extending from the other end thereof, each of said shank portions having a generally inwardly directed spindle, and means on said pin portion for releasably connecting said body means to the end of a rotary drill string;

a plurality of jet means mounted through said generally hollow body means for directing fluid from the interior of said body means generally between adjacent ones of said plurality of shank means;

cone means rotatably mounted upon each spindle for engaging and boring through earth formations, each of said cone means having, a plurality of elevated, primary, land areas, each of which originates from the apex of a cone and extends in a spiral pattern to the base of the cone; and a plurality of elevated, secondary, land areas each of which originates from a point intermediate the apex and base of the cone and extends in a spiral pattern to the base of the cone, said plurality of elevated, secondary, land areas extend alternately between said plurality of elevated, primary, land areas; and cutting teeth means mounted upon each of said primary and secondary spiral land areas for digging into earth formations as said body means and cone means rotate during a drilling operation.

2. A rotary drill bit as defined in claim 1 wherein:

each of said cutting cones is fashioned with four primary, spiral, land areas and four secondary, spiral, land areas.

3. A rotary drill as defined in claims 1 or 2 wherein said cutting teeth each comprise:

partial disc shaped members which are mounted upon the elevated land areas of each of said cone means.

4. A rotary drill bit as defined in claim 3 wherein:

said partial disc shaped cutting teeth are each mounted generally in alignment with imaginary lines of generation extending from the apex to the base of each cone and thus said cutting teeth are positioned transverse to the direction of travel of the disc through an earth formation.

5. A rotary drill bit as defined in claim 3 wherein:

each of said partial disc shaped cutting teeth have an upper semi-disc portion which projects above a land area and a lower cylindrical portion which is embedded within the land zone to mount the generally disc shaped cutting tooth on said cone means.

6. A rotary drill bit as defined in claim 3 wherein:

each of said partial disc shaped cutting teeth has an upper semi-disc portion which projects above a land area and a lower non-cylindrical portion which is embedded within the land area to mount the generally disc shaped cutting tooth on said cone means.

7. A rotary drill bit for drilling bore holes through earth formations, said rotary drill bit comprising:

a generally hollow body means having a plurality of shank portions extending generally longitudinally from one end thereof and a pin portion extending from the other end thereof, each of said shank portions having a spindle which is generally directed inwardly, and means on said pin portion for releasably connecting said body means to the end of a rotary drill string;

a plurality of jet means mounted through said generally hollow means for directing fluid from the interior of said body means generally between said plurality of shank means;

cone means rotatably mounted upon each spindle for engaging and boring through earth formations, each of said cone means having, a plurality of raised land areas which originate from a position adjacent the apex of a cone and extend in a spiral pattern to the base of the cone; and partial disc shaped cutting teeth mounted upon each of said spiral land areas for digging into earth formations as said body means and cone means rotate during a drilling operation.

8. A rotary drill bit as defined in claim 7 wherein:

said partial disc shaped cutting teeth are each mounted generally in alignment with imaginary lines of generation extending from the apex to the base of each cone and thus said cutting teeth are positioned transverse to the direction of travel of the disc through an earth formation.

9. A rotary drill bit as defined in claim 8 wherein:

each of said partial disc shaped cutting teeth have an upper semi-disc portion which projects above a land area and a lower cylindrical portion which is embedded within a land area to mount the generally disc shaped cutting tooth on said cone means.

10. A rotary drill bit as defined in claim 8 wherein:

each of said partial disc shaped cutting teeth have an upper semi-disc portion which projects above a land area and a lower non-cylindrical portion which is embedded within a land area to mount the generally disc shaped cutting tooth on said cone means.

11. A rotary drill bit as defined in claims 1 or 7 wherein each of said cone means further comprises:

an arcuate, annular enlargement zone formed at the base of each cone means for engaging the lateral surface of a bore hole and reaming the maximum gauge of the bore hole as the rotary drill bit penetrates through earth formations.

12. A rotary bit cone operable to be mounted upon a rotary drill bit for drilling bore holes through earth formations, said rotary cone comprising:

a generally hollow cone body having, an interior configuration operable to be rotatably mounted upon a spindle of a rotary drill bit, and a generally conical shaped exterior configuration;

a plurality of elevated, primary, land areas formed upon the exterior surface of said cone body, each of said primary land areas originating from the apex of said cone body and extending in a spiral pattern to the base of the cone body;

a plurality of elevated, secondary, land areas formed upon the exterior surface of said cone body, each of said secondary land areas originating from a point intermediate the apex and base of the cone and extending in a spiral pattern to the base of the cone, said plurality of elevated, secondary, land areas extending alternately between said plurality of raised primary land areas; and cutting teeth means mounted upon each of said primary and secondary spiral land areas for digging into earth formations as the cone rotates during a drilling operation.

13. A rotary bit cone as defined in claim 12 wherein:

said bit cone is fashioned with four primary, spiral, land areas and four secondary, spiral, land areas.

14. A rotary bit cone as defined in claim 12 wherein said cutting teeth each comprise:

partial disc shaped members which are mounted upon the elevated, spiral, land areas of said bit cone.

15. A rotary bit cone operable to be mounted upon a rotary drill bit for drilling bore holes through earth formations, said rotary cone comprising:

a generally hollow cone body having, an interior configuration operable to be rotatably mounted upon a spindle of a rotary drill bit, and a generally conical shaped exterior configuration;

a plurality of elevated land areas each of which originates from a position adjacent the apex of the cone and extends in a spiral pattern to the base of the cone; and partial disc shaped cutting teeth mounted upon each of said spiral land areas for digging into earth formations as the cone rotates during a drilling operation.

16. A rotary drill bit as defined in claim 15 wherein:

said partial disc shaped cutting teeth are each mounted generally in alignment with imaginary lines of generation extending from the apex to the base of the cone such that said disc shaped cutting teeth are transverse to the direction of travel of the cutting teeth through an earth formation.

17. A rotary bit cone as defined in claim 12 or 15 and further comprising:

an arcuate, annular enlargement zone formed at the base of said generally hollow cone body and being operable to engage a lateral surface of a bore hole for reaming an enlargement in the bore hole during a drilling operation.

* * * * *